US007114965B2

(12) United States Patent
Jin

(10) Patent No.: US 7,114,965 B2
(45) Date of Patent: Oct. 3, 2006

(54) STRUCTURE OF CONNECTION PIN IN ELECTRICAL CONNECTOR

(75) Inventor: Jang Beom Jin, Chungcheongnam-do (KR)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/496,518

(22) PCT Filed: Dec. 11, 2002

(86) PCT No.: PCT/US02/39424
§ 371 (c)(1),
(2), (4) Date: Mar. 18, 2005

(87) PCT Pub. No.: WO03/055007

PCT Pub. Date: Jul. 3, 2003

(65) Prior Publication Data

US 2005/0208841 A1 Sep. 22, 2005

(30) Foreign Application Priority Data

Dec. 11, 2001 (KR) ..... 10-2001-0078066

(51) Int. Cl.
*H01R 12/00* (2006.01)

(52) U.S. Cl. ..... 439/83; 439/79

(58) Field of Classification Search ..... 439/83, 439/79, 733, 80–82, 65
See application file for complete search history.

(56) References Cited

U.S. PATENT DOCUMENTS 6,280,206 B1 * 8/2001 Kuroda et al. ..... 439/83
6,672,885 B1 * 1/2004 Kuroda et al. ..... 439/79

* cited by examiner

*Primary Examiner*—Alexander Gilman
(74) *Attorney, Agent, or Firm*—Thomas D. Paulius

(57) ABSTRACT

A structure for a connection pin in an electrical connector (100) is disclosed, in which each connection pin (130) includes a portion (136) which is curved laterally, then longitudinally rearwardly, from a rear end of a first electrical contact (132), to terminate in a second electrical contact (134). A width dimension of the curved portion (136) of the contact between upper and lower surfaces of the curved portion is larger than a width dimension of the first electrical contact (132). Also, a width dimension between upper and lower surfaces of the second electrical contact (134) is larger than a width dimension of the curved portion of the contact. A mating part (116) in the connector housing (110), which is formed to correspond to the shape of the connection pin (130) and with which the connection pin is mated, comprises a front mating groove (116*a*) into which the first electrical contact (132) is inserted and mated, and a rear mating groove (116*b*), which has a width dimension sized to receive both the curved portion (136) of the connection pin and the second electrical contact (134).

4 Claims, 7 Drawing Sheets

PRIOR ART

STRUCTURE OF CONNECTION PIN IN ELECTRICAL CONNECTOR

FIELD OF THE INVENTION

The present invention relates to a connection pin structure in an electrical connector wherein one end of the connection pin is mated with an electrical contact of a printed circuit board, and the other end of the connection pin is mated with an electrical contact of a mating connector.

BACKGROUND OF THE INVENTION

Connectors are generally known in the art for electrically connecting input and output terminals of electronic devices, such as notebook computers, camcorders, etc. Connections between the input and output terminals of a device are generally made via one or more connection pins mounted in the connector. One example of such a connection pin will be explained with reference to FIGS. 1 and 2 below. FIG. 1 is an exploded view of a female connector 10 incorporating a conventional connection pin 16. FIG. 2 is a rear view of the connector of FIG. 1 showing two connection pins 16 secured in a housing 12 of the connector.

Referring to FIGS. 1 and 2, female connector 10 comprises a connector housing 12 having a mating hole (not shown) through which a male connector 20 is inserted, and mating parts (not shown) formed in sides of the housing on a front surface of the housing for receiving reinforcement pins therein. Mating parts 12*a* are formed in sides of the housing on a rear surface of the housing for receiving connection pins therein. Reinforcement pins 14 are inserted into complementary mating parts thereof, and connection pins 16 are inserted into complementary mating parts 12*a* thereof.

In female connector 10, each of the connection pins 16 comprises a first electrical contact 16*a*, adapted to be inserted through a hole 22 of complementary male connector 20 and is adapted to be mated with an electrical contact of the male connector, and a second electrical contact 16*b*, which is adapted for soldering to an electrical contact 32 of an underlying printed circuit board 30.

As seen in FIG. 1, second electrical contact 16*b* of connection pin 16 is formed in an inverted "U" shape and extends outwardly from a rear end of connector housing 12. During soldering of second electrical contact 16*b* to electrical contact 32 of printed circuit board 30, and of reinforcement pin 14 to a corresponding stationary contact (not shown) of printed circuit board 30, bending of second electrical contact 16*b* of connection pin 16 due to impact or vibration may be prevented.

However, when employing the conventional connection pin structure described above, it is difficult to accurately form an inverted "U"-shaped mating part which conforms to the corresponding "U"-shape of the connection pin. That is, because the connector housing is so small, it is nearly impossible to accurately form a mating part for the connection pin in the shape of a "U".

Accordingly, as the shape of the mating part does not closely conform to the shape of the connection pin, it is difficult to secure the connection pin in the housing, and the connection pin can be bent due to vibration of the connector housing when the connector is mounted and fixed to the printed circuit board. Also, the connection pin can be electrically disconnected from the printed circuit board due to bending of the connection pin.

SUMMARY OF THE INVENTION

Accordingly, an object of the present invention is to provide a connection pin structure in an electrical connector which enables a mating part for the connection pin to be more accurately formed in the connector housing.

Another object of the present invention is to provide a connection pin structure in an electrical connector which is less susceptible to bending due to impact and vibration forces acting on the connector.

Still another object of the present invention is to provide a connection pin structure in an electrical connector which can stabilize the electrical contact interface between the connection pin and a printed circuit board.

Accordingly, the connection pin of the present invention can be easily coupled to a mating part of a connector housing.

In order to accomplish these objects, there is provided a connection pin structure in an electrical connector, the electrical connector comprising a female connector including a connector housing, and at least one connection pin. The connector housing includes mating parts formed at lower portions of a rear surface thereof for receiving the connection pins therein, and a coupling hole formed at a front surface of the housing. Each connection pin is inserted into and mated with a mating part in the connector housing. Each connection pin includes a first electrical contact for mating with an electrical contact of a male connector, and a second electrical contact for mating with an electrical contact on a printed circuit board. Each connection pin further comprises a curved portion which is first curved laterally from a rear end of the first electrical contact, then is curved again longitudinally and rearwardly to extend to the second electrical contact. A width dimension between upper and lower surfaces of the curved portion of the connection pin is larger than a width dimension of the first electrical contact. Also, a width dimension between upper and lower surfaces of the second electrical contact is larger than a width dimension of the curved portion of the connection pin. Each mating part in the connector housing has a front mating groove that is formed to correspond to the shape of the first electrical contact. The first electrical contact is inserted into and mated with the front-mating groove. Each mating part also includes a rear mating groove which has a dimension corresponding to the distance between an outer side of the first electrical contact and an outer side of the second electrical contact. The curved portion and the second electrical contact are inserted into and mated with the rear mating groove.

Each connection pin further comprises wedge-shaped flanges formed on upper and lower surfaces of a rear portion of the first electrical contact. A dimension taken across the flanges is greater than a separation distance between upper and lower surfaces of the front mating groove, such that the wedge-shaped flanges penetrate into the upper and lower surfaces of the front mating groove, thereby locating and securing the connection pin in the mating part of the connector housing when the connection pin is inserted into and mated with the mating part.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE INVENTION

Figure 1:
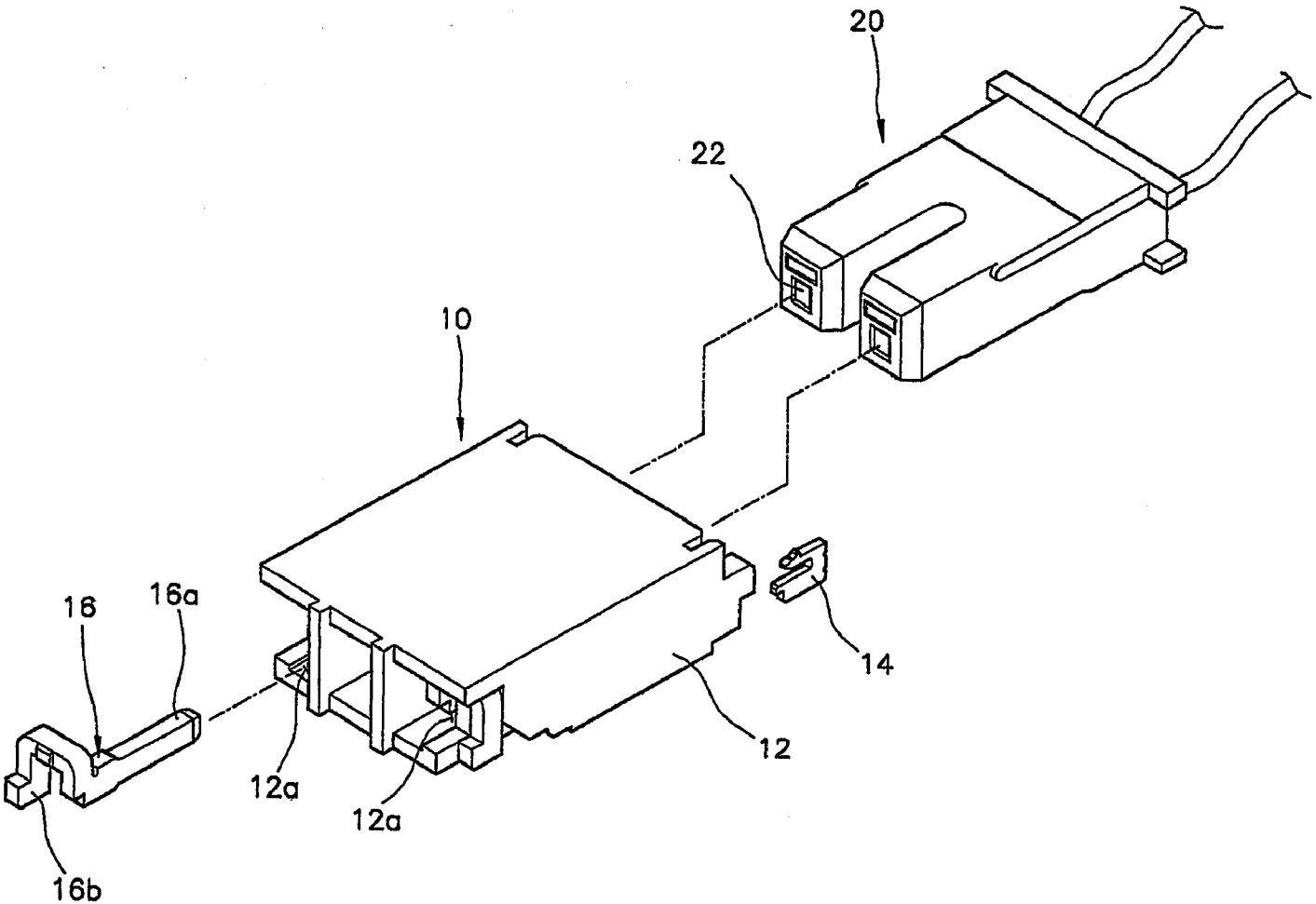
FIG. 1 is an exploded view showing a prior art connection pin structure employed in an electrical connector.

Hereinafter, embodiments of the present invention will be described with reference to the accompanying drawings. In the following description and drawings, the same reference numerals are used to designate the same or similar components, and so repetition of the description of the same or similar components will be omitted.

Figure 2:
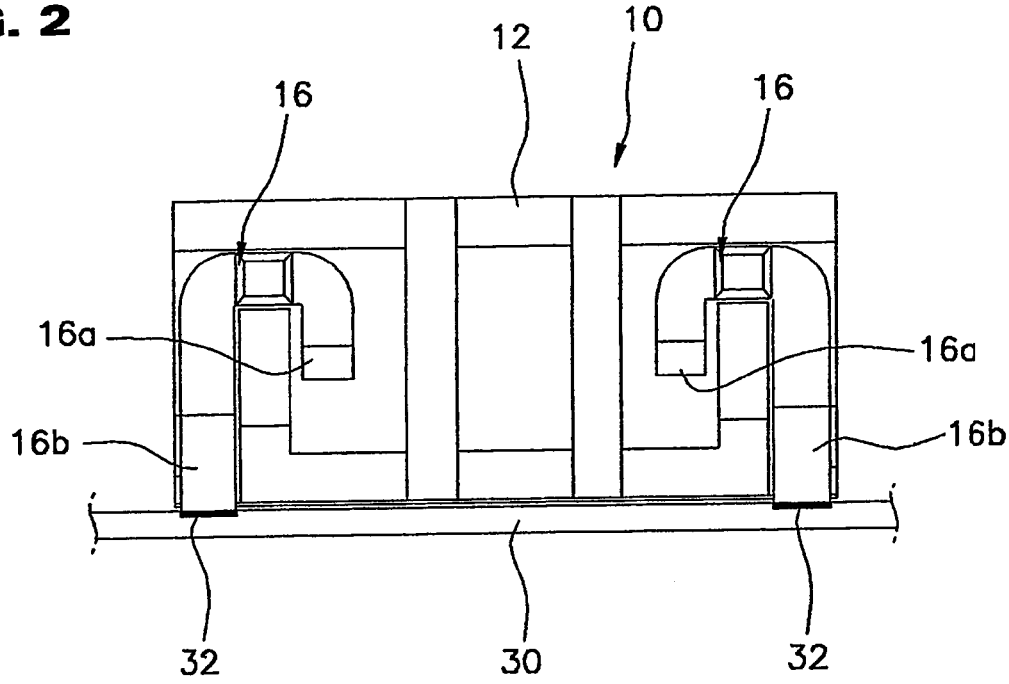
FIG. 2 is a rear view of the connector of FIG. 1 showing the connection pins secured in a housing of the connector.
Figure 3:
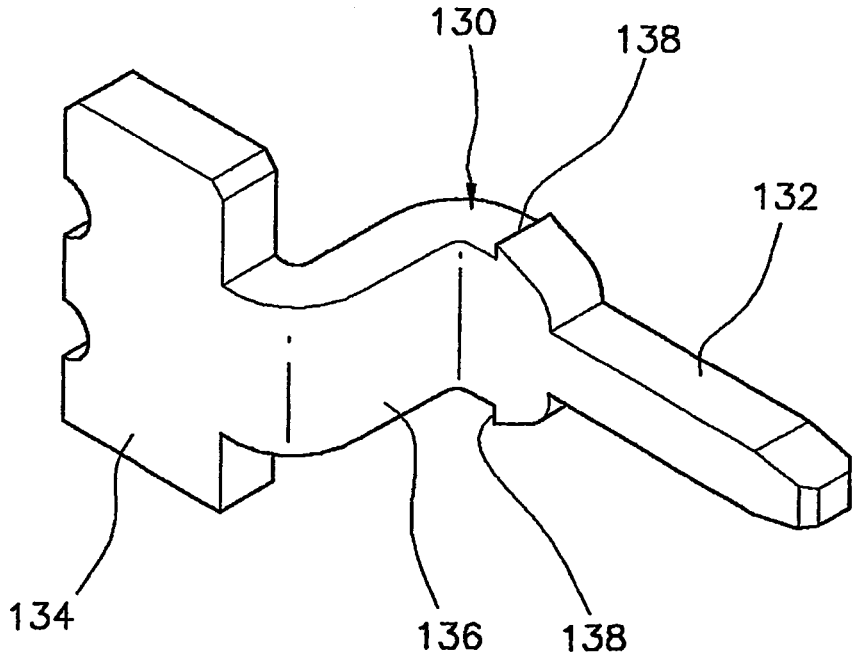
PRIOR ART FIG. 3
FIG. 3 is a perspective view of a connection pin structure in accordance with the present invention.
Figure 4:
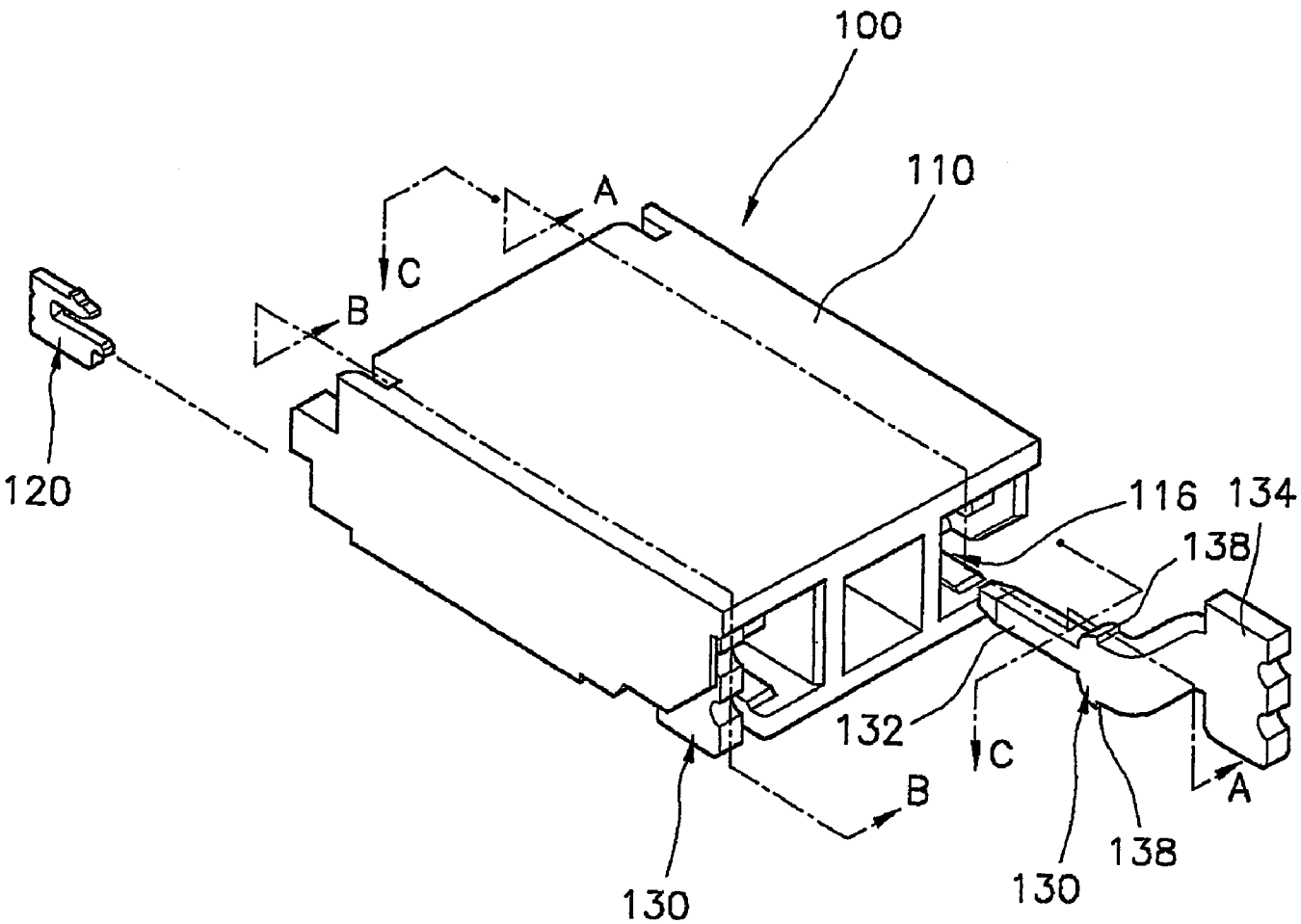
FIG. 4 is an exploded view of a connector incorporating the connection pin of FIG. 3.
Figure 5:
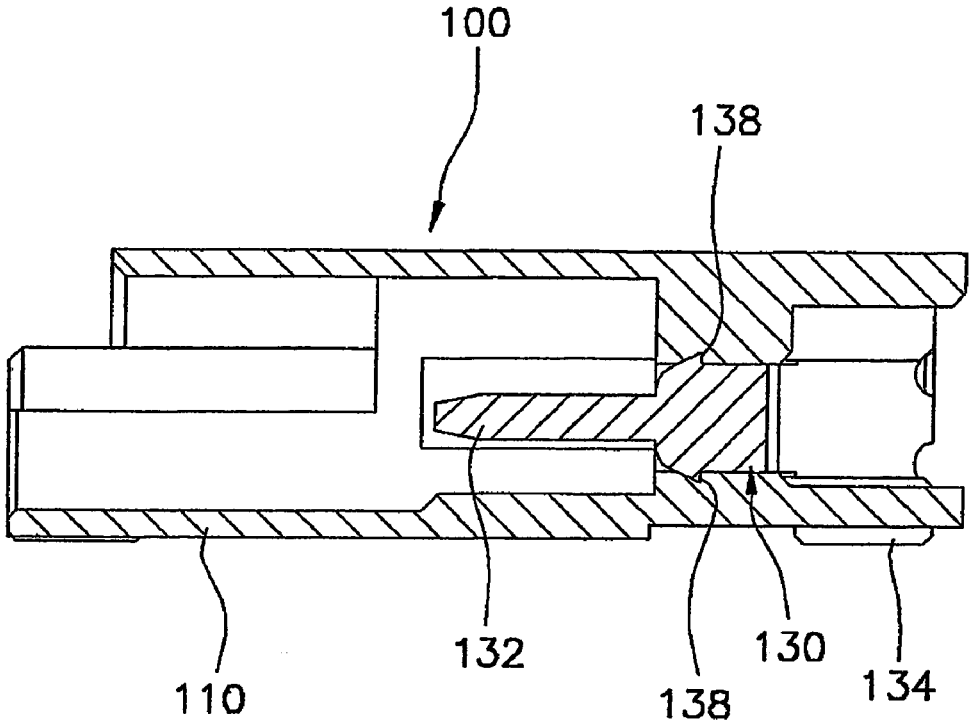
FIG. 5 is a sectional view of the connector of FIG. 4, taken along line "A-A" of FIG. 4.
Figure 6:
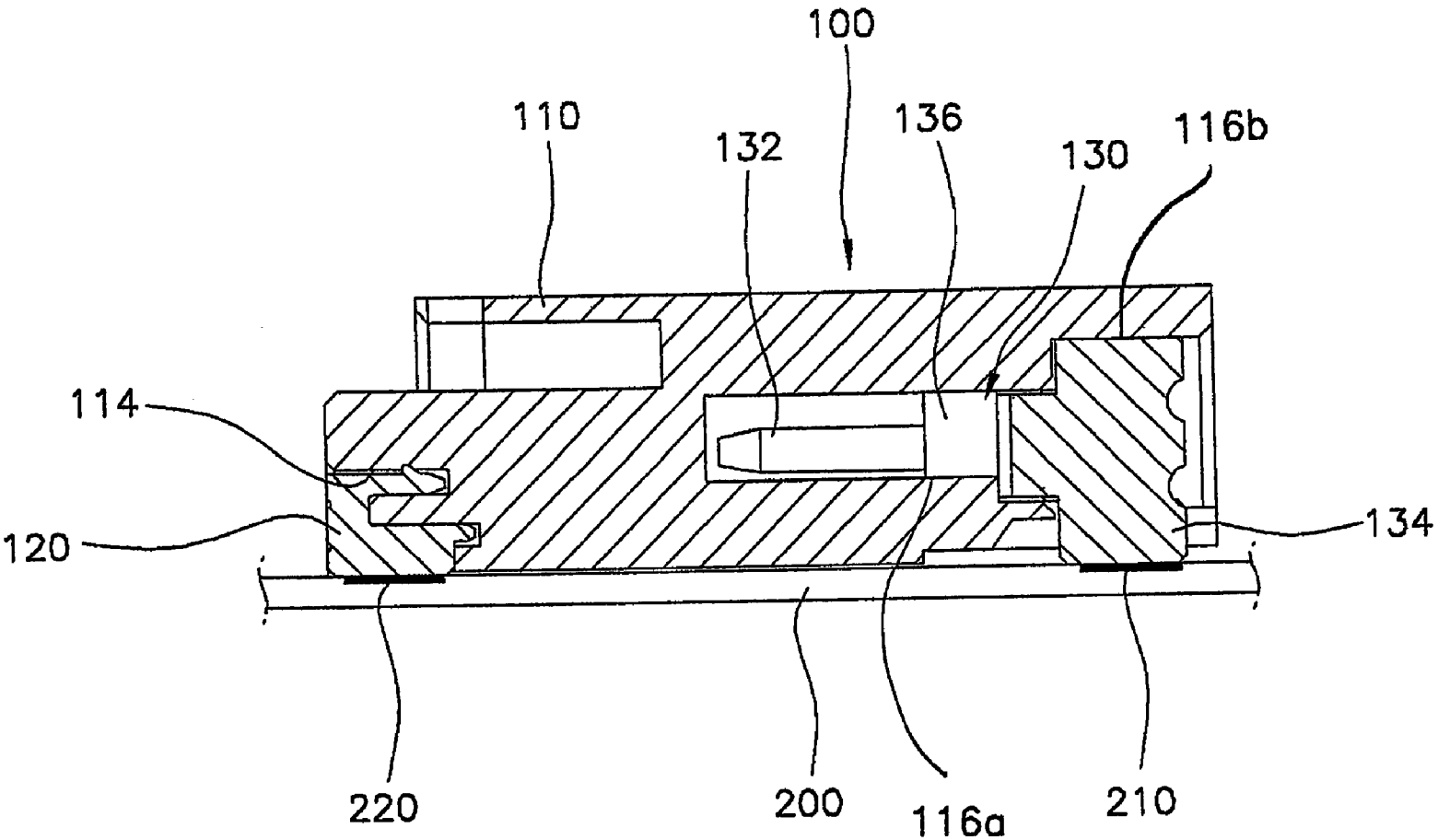
FIG. 6 is a sectional view of the connector of FIG. 4 taken along line "B-B" of FIG. 4.

FIGS. 3 to 8 show a female connector 100 for electrically connecting inputs and outputs of a notebook computer, camcorder, etc., in accordance with the present invention. As seen in FIGS. 4 and 6, connector 100 includes the same basic components as the female connector 10 shown in FIGS. 1 and 2, such as a connector housing 110 having a mating hole through which a male connector is inserted, mating parts 114 formed on sides of a front surface of the housing for receiving reinforcement pins therein, and mating parts 116 formed on sides of a rear surface of housing 110 for receiving connection pins 130 therein. Connector 100 also includes reinforcement pins 120 inserted into mating parts 114 and connection pins 130 inserted into mating parts 116 thereof. However, according to the present invention, structures of the connection pins 130 and the mating parts 116 formed in the housing are different from those of the prior art.

As seen in FIG. 3, connection pin 130 comprises a first electrical contact 132 for electrical connection to a mating contact of a complementary male connector, a second electrical contact 134 for electrical connection to an electrical contact 210 of a printed circuit board 200, and a curved portion 136 which connects first electrical contact 132 to second electrical contact 134.

Still referring to FIG. 3, first electrical contact 132 extends longitudinally, and curved portion 136 then curves laterally from a rear end of first electrical contact 132. Curved portion 136 then curves again longitudinally and rearwardly to terminate in second electrical contact 134. In this embodiment, second electrical contact 134 is formed so as to be parallel with first electrical contact 132.

The width of curved portion 136 extending between first electrical contact 132 and second electrical contact 134 is larger than the width of first electrical contact 132, and the width of the second electrical contact 134 is larger than the width of curved portion 136 extending between the first and second electrical contacts.

Wedge-shaped flanges 138 are formed on lower and upper surfaces of a rear end of first electrical contact 132 proximate curved portion 136. Flanges 138 are wider than a mating groove 116*a* formed at a front end of mating part 116 on housing 110 (described in greater detail below), so that wedge-shaped flanges 138 can penetrate into upper and lower surfaces of mating grooves 116*a* to fix and locate connection pin 130 within mating part 116 when connection pin 130 is inserted into mating part 116.

Figure 7:
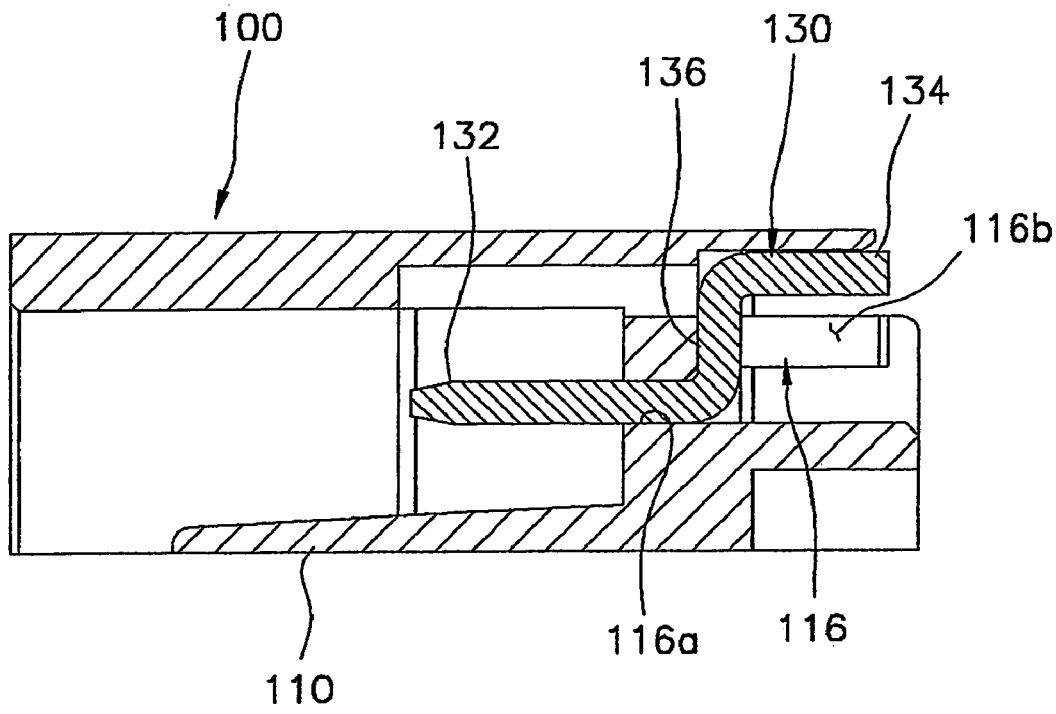
FIG. 7 is a sectional view of the connector of FIG. 4 taken along line "C-C" of FIG. 4.

As shown in FIGS. 4, 6 and 7, mating parts 116 for connection pin 130 are formed in relation to the shape and structure of connection pin 130. That is, each mating part 116 comprises a front mating groove 116*a*, into which first electrical contact 132 of a connection pin is secured, and a rear mating groove 116*b*, which is formed to receive curved portion 136 of connection pin 130 and second electrical contact 134. Front mating groove 116*a* extends forward from and is contiguous with rear mating groove 116*b*. A lower part of rear mating groove 116*b* is open so that a tail part of second electrical contact 134 can be soldered to electrical contact 210 of printed circuit board 200.

A process for mating connection pin 130 with mating part 116 in connector housing 110 will be explained below.

First, a front end of first electrical contact 132 is inserted through rear mating groove 116*b* of mating part 116 and aligned with front mating groove 116*a*. First electrical contract 132 is then press-fit into front mating groove 116*a*.

Referring to FIG. 5, due to wedge-shaped flanges 138 formed on upper and lower surfaces of the rear end of first electrical contact 132, the rear end of first electrical contact 132 has a width greater than the separation distance between upper and lower surfaces of front mating groove 116*a*. As first electrical contact 132 is inserted into front mating groove 116*a*, wedge-shaped flanges 138 penetrate into upper and lower surfaces of mating groove 116*a*, thereby creating an interference fit between connection pin 130 and front mating groove 116*a* to locate and secure connection pin 130 within mating part 116.

Referring to FIG. 7, connection pin 130 is further inserted in the direction of front mating groove 116*a* until a front surface of bent portion 136 abuts a forward surface of rear mating groove 116*b*. At this time, connection pin 130 is fully inserted in connector housing 110.

Figure 8:
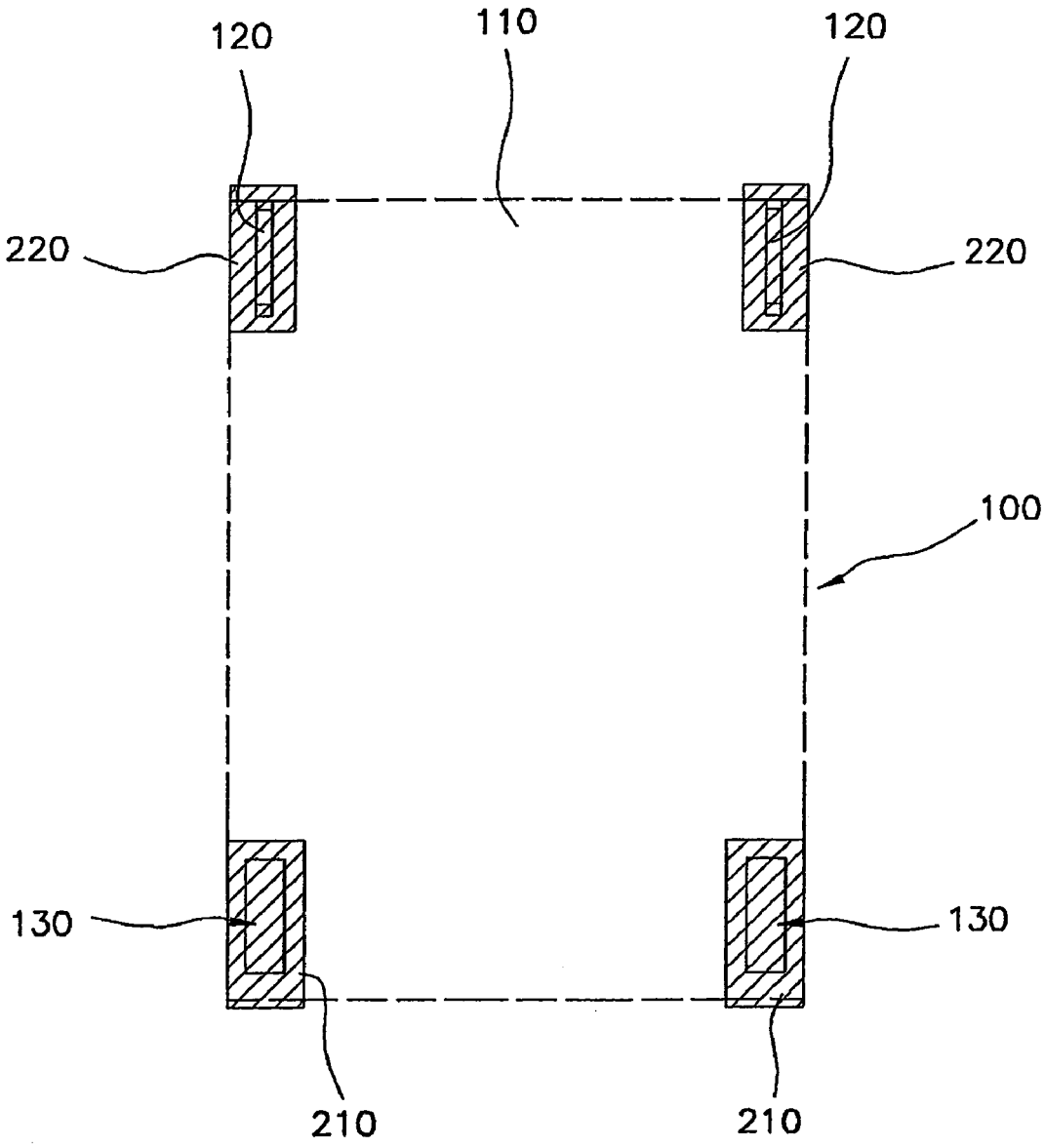
FIG. 8 is a plan view of the connector of FIG. 4 shown attached to a printed circuit board.

Referring to FIGS. 6 & 8, when connection pins 130 have been secured in connector housing 110 as described above, second electrical contact 134 of each connection pin 130 is aligned with a corresponding electrical contact 210 on printed circuit board 200 and reinforcement pins 120 (mounted onto connector housing 110 in a previous operation) are aligned with corresponding stationary electrical contacts 220 on printed circuit board 200. Female connector 100 is then mounted on printed circuit board 200 by a known method such as soldering tails of each second electrical contact 134 and reinforcement pin 120 to corresponding electrical contacts 210 and 220 on the printed circuit board.

Soldering of reinforcement pins 120 to electrical contacts 220 on circuit board 200 acts to reinforce the solder connections between second electrical contacts 134 and printed circuit board contacts 210. This aids in preventing bending of connection pins 130 when the connector experiences forces due to impact or vibration.

Although a preferred embodiment of the present invention has been described for illustrative purposes, those skilled in the art will appreciate that various modifications, additions and substitutions are possible, without departing from the scope and spirit of the invention as disclosed in the accompanying claims.

The invention claimed is:

1. A structure for a connection pin in an electrical connector (100), the electrical connector including a connector housing (110) and at least one connection pin (130), the connector housing including a mating part (116) for the connection pin, each connection pin is adapted for mating with a mating part in the connector housing and is characterized by a first electrical contact (132) for mating with a complementary electrical contact of a mating connector, a second electrical contact (134) for electrical connection to a corresponding contact on a printed circuit board (200), and a curved portion (136) which connects the first electrical contact with the second electrical contact at respective first and second rounded bends in the connection pin (130), wherein the first and second electrical contact extend longitudinally parallel to each other, the curved portion curves laterally from a rear end of the first electrical contact and longitudinally and rearwardly terminating at the second electrical contact, the first and second rounded bends in the connection pin having a bend radius-axes-parallel to each other and perpendicular to the longitudinal extension of the first and second electrical contacts, wherein the second electrical contact (134) is formed so as to be parallel with the first electrical contact (132), and wherein the mating part (116) in the connector housing comprises a front mating groove (116*a*) for securing the first electrical contact therein and a rear mating groove (116*b*) for securing the curved portion and the second electrical contact therein.

2. The structure for a connection pin according to claim 1, wherein the connection pin (130) further comprises wedge-shaped flanges (138) formed on upper and lower surfaces of a rear end of the first elecirical contact (132), a separation distance between the flanges being greater than a corresponding separation distance between an upper surface and lower surface of the front mating groove such that the wedge-shaped flanges penetrate into the upper and lower surfaces of the front mating groove during insertion of the connection pin into the mating part, thereby fixing and locating the connection pin in the mating part of the connector housing.

3. The structure for a connection pin according to claim 1, wherein a width of the curved portion between upper and lower surfaces of the curved portion is larger than a width of the first electrical contact.

4. The structure for a connection pin according to claim 1, wherein a width of the second electrical contact between upper and lower surfaces of the second electrical contact is larger than a width of the curved portion.

* * * * *